US008464374B1

(12) United States Patent
Thayer

(10) Patent No.: US 8,464,374 B1
(45) Date of Patent: Jun. 18, 2013

(54) MULTI-FUNCTIONAL CONVERTIBLE BLANKET

(76) Inventor: Randall Adam Thayer, Tampa, FL (US)

( * ) Notice: Subject to any disclaimer, the term of this patent is extended or adjusted under 35 U.S.C. 154(b) by 311 days.

(21) Appl. No.: 12/942,263

(22) Filed: Nov. 9, 2010

(51) Int. Cl.
*A47G 9/06* (2006.01)
*A47G 9/08* (2006.01)
*A41D 15/04* (2006.01)

(52) U.S. Cl.
USPC ..... 5/482; 5/485; 5/413 R; 5/417; 2/69; 2/69.5

(58) Field of Classification Search
USPC ..... 5/413 R, 413 AM, 417–420, 494, 5/485, 482; 2/69, 69.5, 84
See application file for complete search history.

(56) References Cited

U.S. PATENT DOCUMENTS

| | | | | | |
|---|---|---|---|---|---|
| 782,819 | A | | 2/1905 | Bikle | |
| 1,252,628 | A | * | 1/1918 | Terry | 2/89 |
| 2,644,948 | A | * | 7/1953 | Gutmann | 2/69.5 |
| 3,013,274 | A | * | 12/1961 | Dike | 2/69 |
| 3,176,315 | A | * | 4/1965 | Freund | 2/69 |
| 3,381,306 | A | * | 5/1968 | Innes | 2/69 |
| 3,958,274 | A | * | 5/1976 | Klauber | 2/69 |
| 4,180,867 | A | * | 1/1980 | Ridgeway, Jr. | 2/89 |
| 4,484,362 | A | * | 11/1984 | Asher | 2/69 |
| 4,573,227 | A | | 3/1986 | Prandina | |
| 4,656,670 | A | * | 4/1987 | Schluter | 2/92 |
| 4,789,247 | A | | 12/1988 | Schnoor | |
| 5,443,488 | A | | 8/1995 | Namenye et al. | |
| 5,463,783 | A | * | 11/1995 | Pope | 5/417 |
| 5,697,102 | A | * | 12/1997 | Benjamin | 2/84 |
| 5,887,301 | A | | 3/1999 | Anderson | |
| 6,014,772 | A | * | 1/2000 | Connelly | 2/69 |
| 6,223,367 | B1 | | 5/2001 | French et al. | |
| 6,275,993 | B1 | * | 8/2001 | McCarley | 2/84 |
| 6,393,637 | B1 | * | 5/2002 | Hoffman | 5/413 R |
| 6,643,870 | B2 | | 11/2003 | Bertrand | |
| 6,966,069 | B2 | | 11/2005 | Booth | |
| 7,832,032 | B2 | * | 11/2010 | Haislip | 5/413 R |
| 2007/0136946 | A1 | * | 6/2007 | Haislip | 5/413 R |
| 2010/0256716 | A1 | * | 10/2010 | Haislip | 607/108 |

* cited by examiner

*Primary Examiner* — Robert G Santos
(74) *Attorney, Agent, or Firm* — Robert J. Varkonyi; Smith & Hopen, P.A.

(57) ABSTRACT

The blanket is designed to adjust in dimension and performance, permitting a user to use the blanket in a multitude of situations. The body of the blanket has a head opening and a series of complementary zippers attached to the blanket. Complementary zipper halves are attached to the left and right edges of the blanket body, permitting the right and left edges of the blanket to be attached together or for other blankets of the invention to be attached, forming a larger blanket. Another complementary zipper set includes zipper halves attached to the bottom edge of the blanket and about one third up the blanket to allow shortening of the blanket length. A plurality of foot pockets are placed on the lower portion of the blanket. The blanket may also be folded up into a bag and carried using a strap.

20 Claims, 6 Drawing Sheets

MULTI-FUNCTIONAL CONVERTIBLE BLANKET

FIELD OF INVENTION

This invention relates to blankets. Specifically, the invention provides a convertible blanket adapted to provide multiple functions.

BACKGROUND OF THE INVENTION

Robes and blankets have been used for numerous purposes, including bedsheets, as a warmer, and for emergency situations. Blankets tend to slide or require occasional repositioning throughout use. The repositioning of the blanket can be difficult or annoying. Bertrand (U.S. Pat. No. 6,643,870) and Booth (U.S. Pat. No. 6,966,069) designed blankets to address this issue. The previous blankets do not use a storage system, or use a rudimentary bag to pack the blanket. For example, French (U.S. Pat. No. 6,223,367) uses a blanket with an attached storage bag and pillow. Likewise, Bikle (U.S. Pat. No. 782,819) noted issues with children wriggling out of clothes and blankets, which had previously been addressed with specially fitted clothes. Bikle's solution provided a flat blanket having a U-shaped head opening and arm flaps and fasteners to secure a child.

However, the blankets provided in the art are all designed and manufactured for specific uses. As such, what is needed in the art is a multifunctional blanket which permits a user to possess fewer blankets and use the blanket in more situations.

SUMMARY OF INVENTION

The convertible blanket permits a user to use the blanket in a multitude of situations, adjusting the dimensions and performance of the blanket to the user as needed. The blanket may be made of any material known in the art to be useful in forming blankets, such as but not limited to flannel, polyester, cotton, rayon, or cashmere. The blanket comprises a substantially rectangular body having an upper edge, a lower edge, a left edge, and a right edge; and has a first face and a second face. The body has an opening about one third the length of the blanket from the upper edge of the blanket, of sufficient size to allow the user to insert his or her head through the opening. The blanket wraps over the shoulders of the user, forming sleeve 4 of the blanket. The sleeved region may have snaps or other fasteners as known in the art connect the upper edge of the blanket, now behind the user, to the body of the blanket in front of the user forming sleeves.

A series of complementary zippers are attached to the blanket. A first zipper half is attached to the left edge of the blanket body, with a complementary second zipper half disposed on the right edge of the blanket body. This permits the right and left edges of the blanket to be attached together or for other blankets of the invention to be attached, forming a larger blanket. Another complementary zipper set includes one zipper half attached to the bottom edge of the blanket and one zipper half attached to the face of the blanket, about one third the length of the blanket from the bottom edge of the blanket body.

A plurality of foot pockets are formed by attaching fabric or other material to the lower edge of the blanket and partway up the right and left edges of the blanket. A least one seam is formed on the body of the blanket, breaking the pocket into the plurality of pockets. Alternatively, the pockets may be formed from different pieces of fabric or material. For example, where the blanket uses three foot pockets, one large piece of fabric can be separated into three pockets as known in the art, such as by sewing. The pocket may instead be formed from multiple pieces, such as three pieces of fabric can be attached to the blanket to form the three pockets. In some variants of the blanket, the foot pockets are disposed on the second face of the blanket body.

The blanket may also have a plurality of fasteners attached to the second face of the blanket body. The fasteners may be attached to the blanket at about the edges of the upper edge of the blanket, with complementary fasteners at about one third the blanket's length from the upper edge of the blanket. While the fasteners may be any known in the art, exemplary fasteners are buttons, snaps, hooks, or Velcro.

Variants of the blanket may also include a plurality of hooks attached to the first face of the blanket. While not intending to limit the scope of the hooks from those known to be useful in the art, exemplary hooks include D-clips, Buckles, fabric loops, or stitched loops. The blanket may further use a strap, adapted to engage the hooks thereby allowing a user to carry the blanket.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

As used herein, "complementary" means the strands or elements are sized and shaped to allow at least one element from one complementary half to engage at least one element from the opposing complementary half.

As used herein, "about" means approximately or nearly and in the context of a numerical value or range set forth means±15% of the numerical.

As used herein, "substantially" means largely if not wholly that which is specified but so close that the difference is insignificant.

Figure 1:
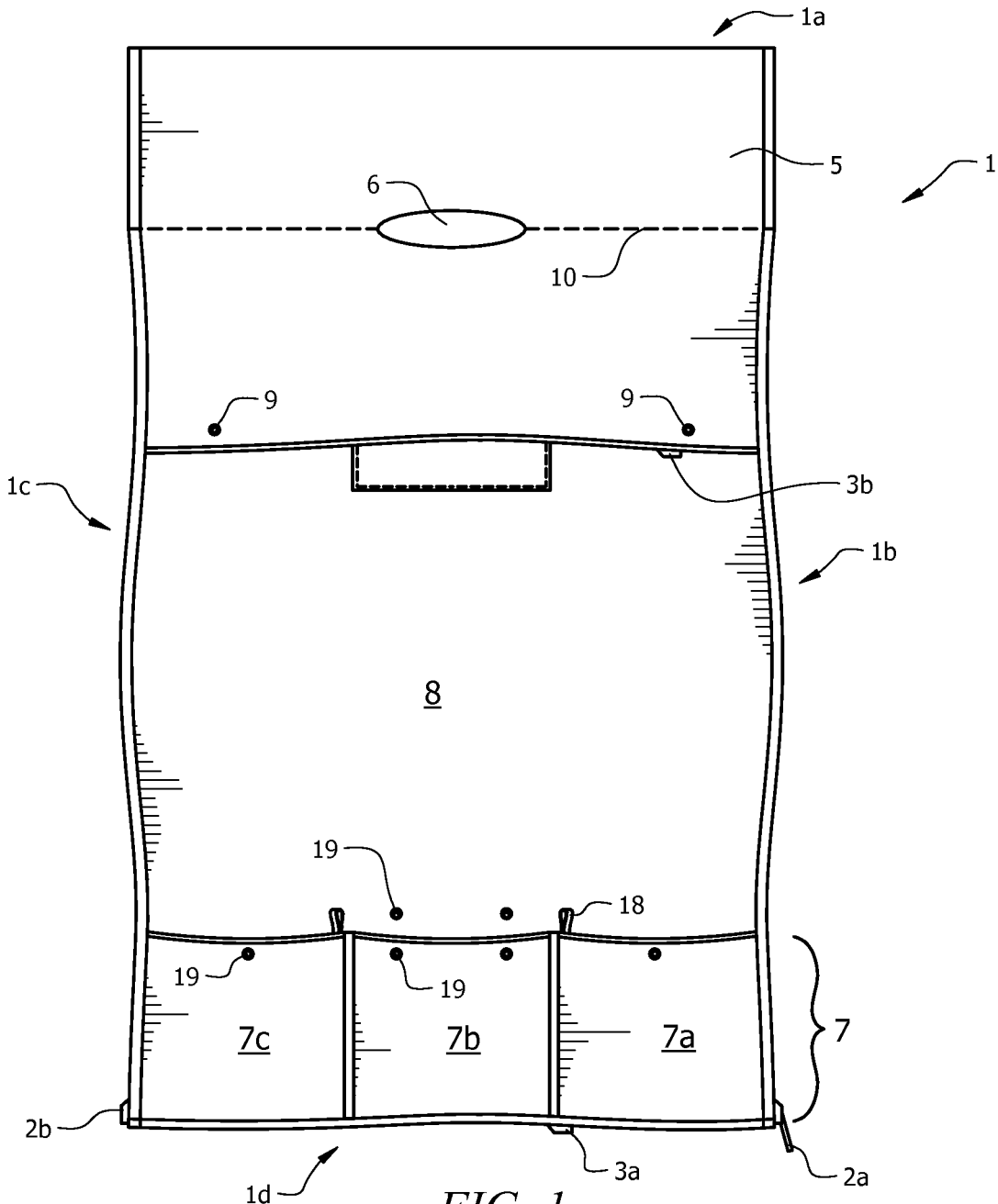
FIG. 1 is an illustration of an embodiment of the inventive blanket unfurled.

The blanket has a general rectangular shape, as seen in FIG. 1. Blanket 1 is made from a fabric, man-made material, or other material suitable for flexible use and capable of forming into a sheet. Non-limiting examples include but not limited to flannel, polyester, cotton, rayon, silk, satin, terry cloth, Vinyl and cashmere. Blanket 1 has upper edge 1*a*, right edge 1*b*, left edge 1*c*, and bottom edge 1*d*. Right zipper half 2*a* is mounted by means known in the art to right edge 1*b*. Non-limiting examples of mounting methods include stitching, fabric adhesives, hot glue, tape, and thermal bonding. Left zipper half 2*b* is mounted to left edge 1*c* and bottom zipper half 3*a* mounted to bottom edge 1*d* in a similar fashion as right zipper half 2*a*. Upper zipper half 3*b* is disposed approximately one third the blanket's length, similar to the previous zippers. Alternatively, upper zipper half 3*b* is attached to a portion of fabric, forming a flap over the front face of the blanket.

Figure 2:
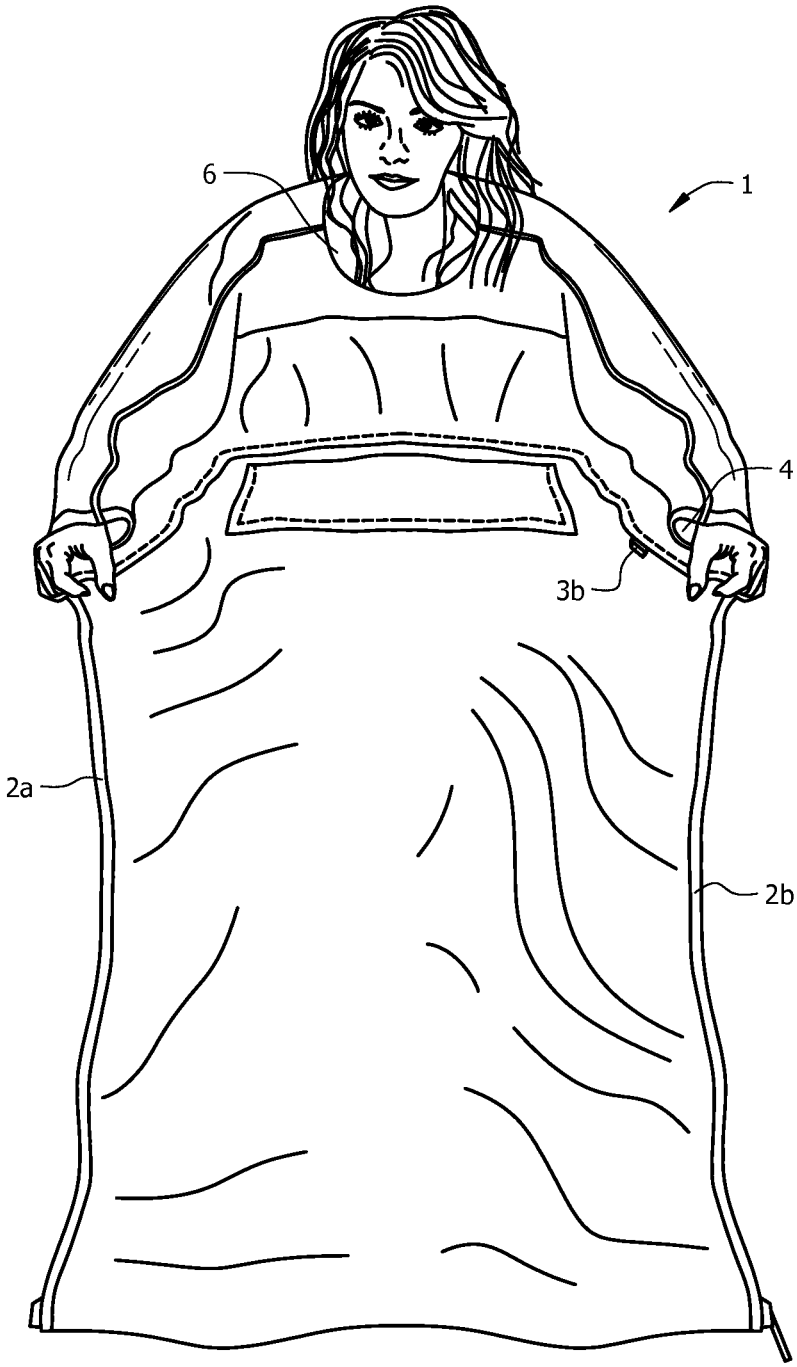
FIG. 2 is a diagram of the inventive blanket in a front-covering position.

The blanket comprises a first face, or front face, and a second, or back, face. The blanket also includes front portion 8 which covers the front of the user, and rear portion 5, which is designed to cover the top portion of the user's shoulders and upper back. Front portion 8 and back portion 5 are divided by imaginary line 10, which lies on the anterior shoulder of a user during use. Head opening 6 is disposed on imaginary line 10, allowing the user to easily position the blanket for use. A series of fasteners 9 are disposed on upper edge 1*a*. While the fasteners are described as snaps, any other fasteners known in the art are contemplated, such as but not limited to, buttons, hooks, and Velcro. A corresponding fastener is attached to body 8, allowing shoulder region 5 to wrap around the shoulders of a user and form sleeve 4, as seen in FIG. 2. Advantageously, other blankets rely on trapping the blanket between a seat to fix the position of the blanket, whereas the present invention uses fasteners 9 and head opening 6 to position the blanket.

The blanket may also include straps attached to the first face to shorten the blanket to enable the user to be mobile and not trip during use. The straps are advantageously attached at about one fourth the length of the blanket, from the bottom edge of the blanket. The straps may also be attached to the top edge of pocket region 7 or anywhere along the lower half of the blanket. The straps include snaps to adjoin the ends of the strap, thereby forming a loop. Multiple snaps may be used to adjust the length of the straps. On the upper half of the blanket, such as by sleeve 4, loops are attached to the blanket. This allows the straps to loop around the loops and snap together, engaging the loops and shortening the length of the blanket. As is evident to one skilled in the art, other fasteners may be used in place of the snaps. Non-limiting examples include buckles, velcro, and buttons. The strap and loop system described may be used in other variations, including but not limited to placing the straps and loops on the second face of the blanket.

One or more pockets may also be attached to the blanket for storage. A section of material is attached to the first face of the blanket, such that at least three edges of the material are attached to the blanket as known in the art. The pockets may also have a portion of the fourth face sewn to form a small opening to the pocket. It is within the skill of one in the art to alter the location of the pocket and/or function of the pocket. Variations include adding closure flaps, snaps, snapped flaps, zippers, and the like.

Front portion 1 also includes the foot pocket region 7, below body region 8. Three pockets are attached to the bottom of blanket 1, using means known in the art. The pockets may be attached to either side, but are shown attached to the second face. Right foot pocket 7*a* is preferably mounted to right edge 1*b* and bottom edge 1*d*, thereby forming a right and bottom boundary for right foot pocket 7*a*. Likewise, left foot pocket 7*c* is mounted to left edge 1*c* and bottom edge 1*d* forming a left boundary and bottom boundary. The interior boundary for right foot pocket 7*a* and left foot pocket 7*c* is formed by stitching or otherwise fixing the pocket to the blanket. The stitching forms the left and right boundaries of interior pocket 7*b*, with the bottom boundary formed by mounting the interior foot pocket to bottom edge 1*d*.

To use the invention as a blanket, the user places blanket 1 over the user's body, fitting his or her head through head opening 6, making sure that body region 8 overlays the user's body, akin to a blanket. The user may extend his or her arms into the sleeve-like portion of the blanket, thereby locking the blanket into position on the user. Additionally, the user may insert his or her feet into the foot pockets. Advantageously, the user may insert his or her right foot into right foot pocket 7*a* and left foot into left foot pocket 7*c*, or may insert both feet into interior foot pocket 7*b*. Where two or more individuals are using the blanket, two blankets may be attached together using right zipper half 2*a* and left zipper half 2*b*.

Figure 3:
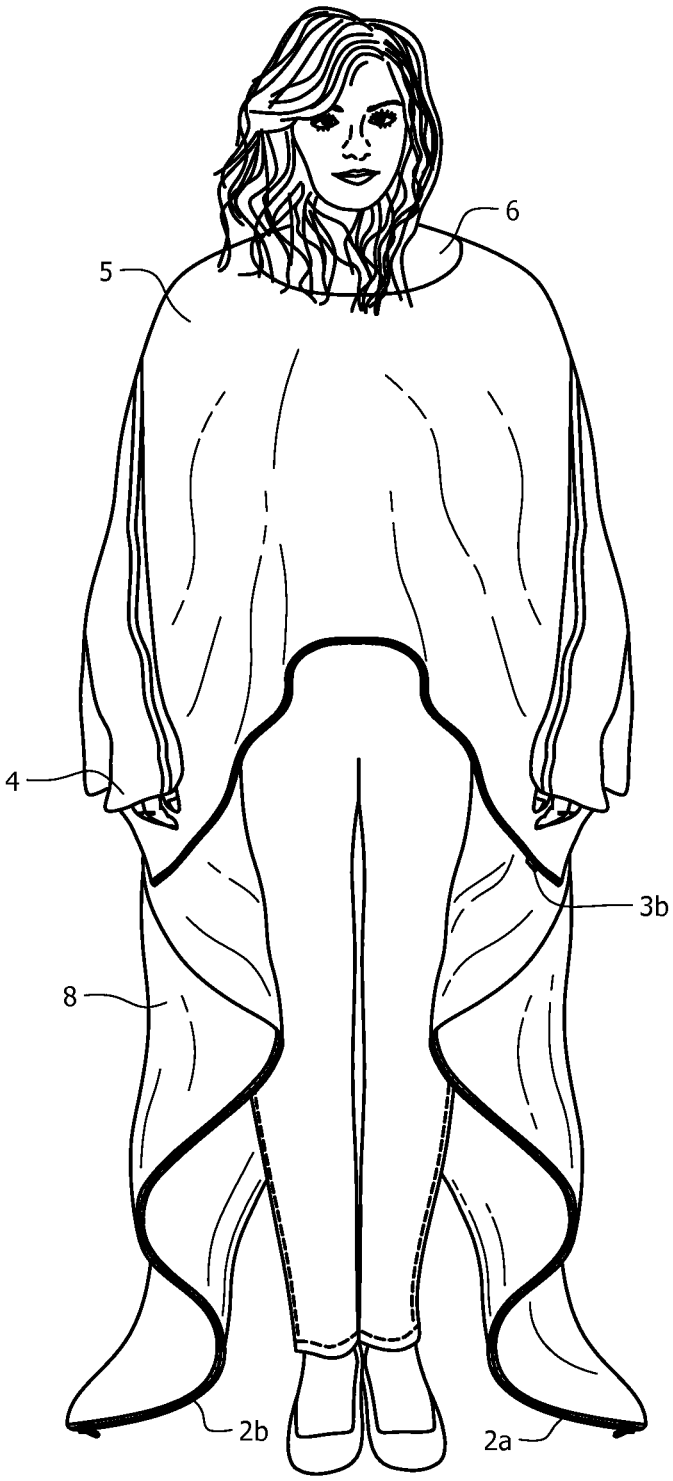
FIG. 3 is a diagram of the inventive blanket in a robe-like position, covering the back of the user.

Blanket 1 may also be worn as shawl-like apparel, as seen in FIG. 3. The user inserts his or head into head opening 5, ensuring that body region 8 is covering the user's back. The blanket covers the shoulders and a portion of the upper torso, providing a limited amount of thermal retention. The user may insert his or her feet into the foot pockets, as described above, to increase thermal retention and warmth of the user's feet. Moreover, should the user wish to walk while wearing the blanket, bottom zipper half 3*a* may be attached to upper zipper half 3*b*, reducing the overall length of the blanket. In an alternative variation, the blanket may be used as a throw to cover the lower torso, legs, and feet of a user, while laying or sitting. The user places the blanket on his or her body as desired, and may lay the blanket over his or her legs. The blanket may also be shortened for use as a throw. The user attaches bottom zipper half 3*a* to upper zipper half 3*b* as discussed above. This increases the thickness of the blanket while concurrently shortening the length. Advantageously, the user may also place his or her feet into the foot pockets of the blanket.

Figure 4:
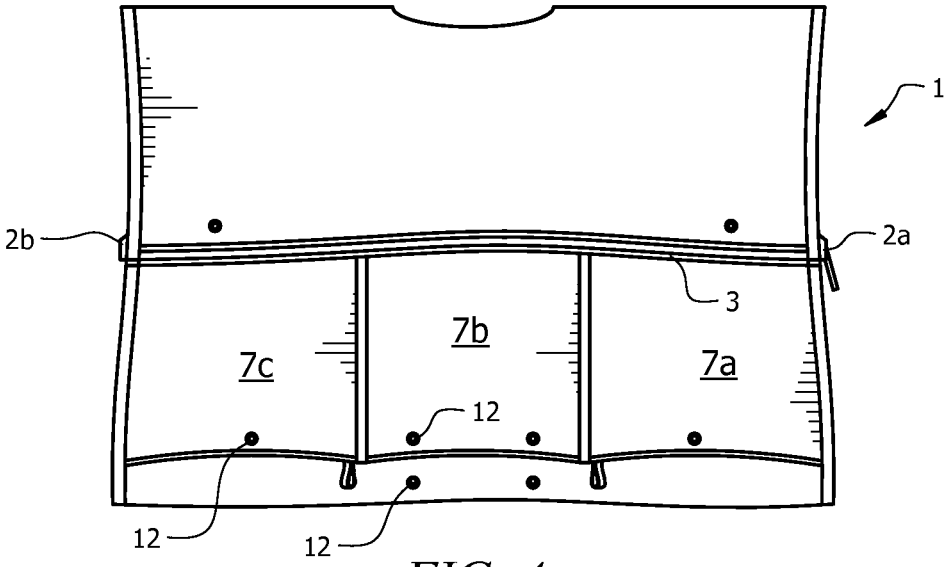
FIG. 4 is a diagram of the inventive blanket in a shawl-like position, partially covering the back of the user.
Figure 5:
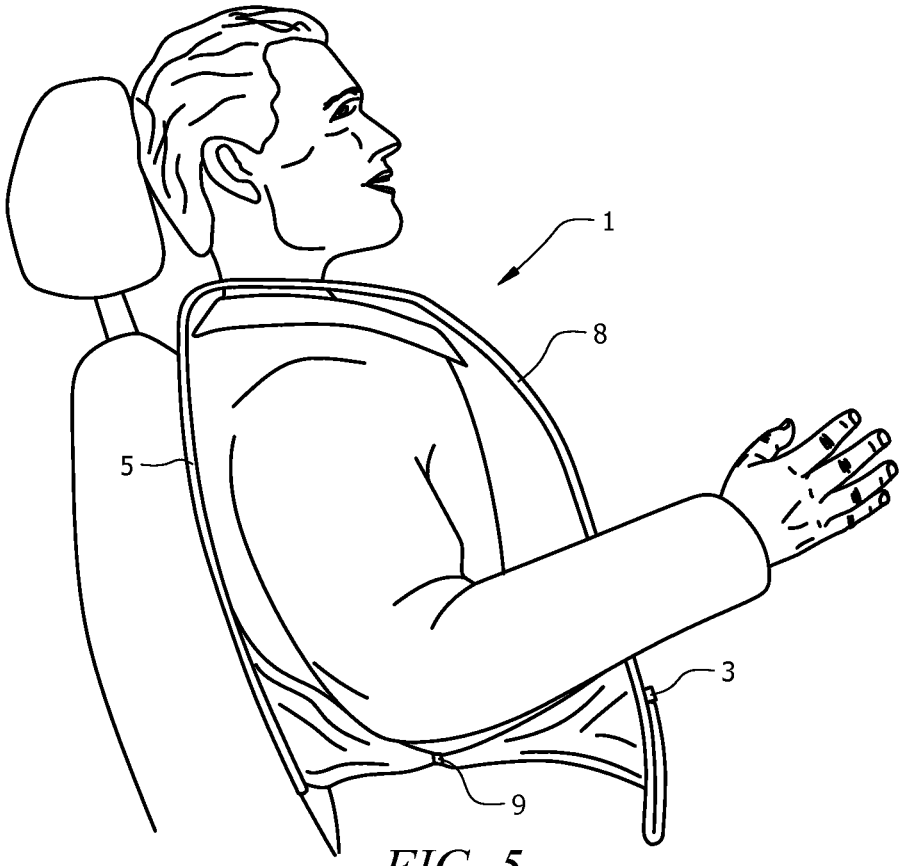
FIG. 5 is a side view diagram of the inventive blanket in a shawl-like position, partially covering the back of the user.

The blanket may be worn by a seated user as a sitting or travel blanket, as seen in FIGS. 4 and 5. As described above, the user places the blanket over his or her head with body region 8 covering the front of the user. The user's arms are placed in a sleeve-like region formed from fastening back region 5 and front region 8 together via fastener 9. As evidenced by Booth (U.S. Pat. No. 6,966,069), many travel blankets only cover the torso of a user. Advantageously, the present blanket may be used to cover the user's entire body, including legs, or as a torso-only blanket. To convert the blanket to a torso-only variant, the user attaches bottom zipper half 3*a* to upper zipper half 3*b*, thereby shortening the length of the blanket as seen in FIG. 4.

Figure 6:
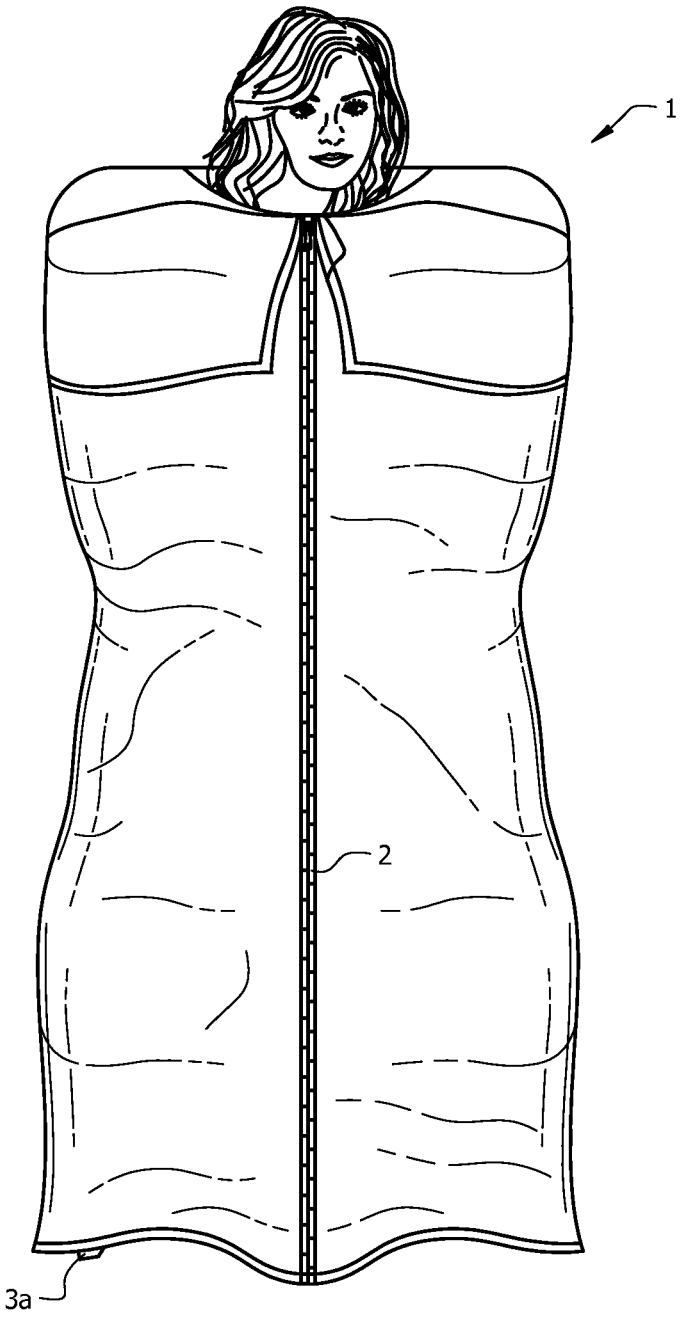
FIG. 6 is a diagram of the inventive blanket in a sleeping bag-like position, with the front opening closed to encapsulate the user.

The blanket may also be used to form a sleeping bag, as seen in FIG. 6. The user places his or her feet into for right foot pocket 7*a* and left foot pocket 7*c*. The user ten brings right edge 1*b* and left edge 1*c* together, fixing the two edges together by zipping right zipper half 2*a* and left zipper half 2*b* together. In this configuration, the blanket forms a tubular structure enwrapping the user in the blanket.

The blanket may also be combined with a second blanket to allow use by multiple users or use on wide beds. As discussed above, each blanket has fasteners on the right edge and left edge of each blanket. Each blanket possesses right zipper half 2*a* and complementary left zipper half 2*b*. This permits each right edge 1*b* to zip onto left edge 1*c* of a second blanket, thereby assembling the two blankets together. The blankets may also include a flap attached to the front face, concealing the right zipper half and/or left zipper half. Further, the flap may be attached to the back face instead of, or in addition to, the flap attached to the front face. This advantageously prevents cool air from traversing the zipper, thereby keeping the user or users warm. As can be envisioned by one skilled in the art, more than two blankets can be attached in this manner.

Figure 7:
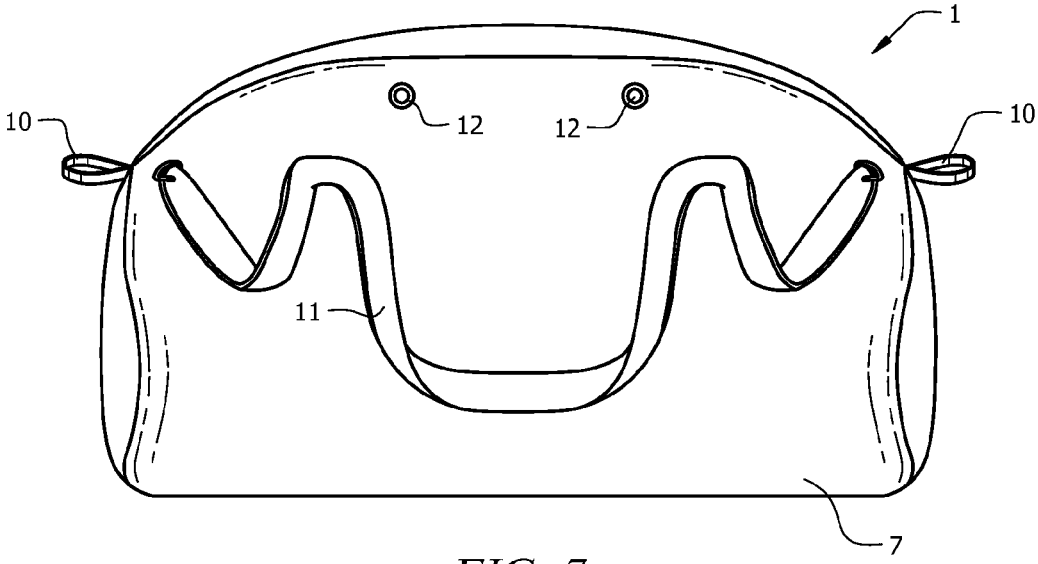
FIG. 7 is a diagram of the inventive blanket is folded into a carrying position.

The blanket can be folded into one of the foot pockets for storage and carrying, as seen in FIG. 7. This advantageously allows the storage features of the blanket to be integrated with other features, reducing the heft and complexity of the blanket. A series of hooks 10 are attached to the top edge of interior pocket 7*b*. The hooks are shown as fabric loops; however any equivalent known in the art, such as, but not limited to D-clips, buckles, spring clips, stitched loops, may be used. The blanket is inserted into the opening of interior pocket 7*b* by inverting the blanket material into the pocket until the blanket forms a bag. Strap 11 is attached to hooks 10 to facilitate carrying. Strap 11 may be made of any suitable material known in the art. Without limiting the scope of the invention, examples includes but not limited to nylon webbing, rope, chain, and fabric. Strap 11 in some embodiments may comprise a compression strap that encircles and supports the bag. Snaps 12 are attached to the upper edge of interior pocket 7*b* and used to close the storage compartment. In some variations, snaps 12 also line the upper edge of all the foot pockets. While snaps are disclosed, one of skill in the art can appreciate that other fasteners known in the art may be used. Some non-limiting examples include zippers, plastic clips, and Velcro. Once secure, the blanket is carried by the straps or handles, as known in the art.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described and illustrated specific embodiments of a convertible blanket, it will be apparent to those skilled in the art that variations and modifications are possible without deviating from the broad spirit and principle of the present invention. It is intended that all matters contained in the foregoing description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween.

What is claimed is:

1. A convertible blanket, comprising
- a substantially rectangular body, wherein the body
  - has an upper edge, a bottom edge, a left edge, a right edge;
  - has a first face and a second face;
- an opening disposed in the body about one third the length of the blanket from the upper edge of the blanket;
- a first zipper half disposed on the left edge of the blanket body;
- a second zipper half disposed on the right edge of the blanket body, wherein the second zipper half is complementary to the first zipper half;
- a third zipper half disposed on the bottom edge of the blanket body; and
- a fourth zipper half disposed on the first face of the blanket body, wherein the fourth zipper half is complementary to the third zipper half, and where the fourth zipper half is disposed about one third the length of the blanket from the bottom edge of the blanket body.

2. The blanket of claim 1, further comprising a plurality of foot pockets disposed on the bottom edge of the blanket.

3. The blanket of claim 2, wherein the blanket has three foot pockets.

4. The blanket of claim 2, wherein the foot pockets are disposed on the second face of the blanket body.

5. The blanket of claim 1, further comprising a plurality of fasteners disposed on the second face of the blanket body, wherein the fasteners are disposed at about the edges of the upper edge of the blanket and at about one third the blanket's length from the upper edge of the blanket.

6. The blanket of claim 5, wherein the fasteners are buttons, snaps, hooks, or a hook and loop type fastener.

7. The blanket of claim 1, wherein the blanket is made of flannel, polyester, cotton, rayon, silk, satin, terry cloth, Vinyl, or cashmere.

8. The blanket of claim 1, further comprising a plurality of hooks disposed on the first face of the blanket, wherein the hooks are D-clips, buckles, spring clips, fabric loops, or stitched loops.

9. The blanket of claim 8, wherein the blanket further comprises a strap, where the strap further comprises
- nylon webbing, rope, chain, or fabric; and
- clips attached to the strap and adapted to engage the hooks, thereby allowing a user to carry the blanket.

10. The blanket of claim 1, further comprising a blanket length adjustment system, where length adjustment comprises
- straps attached to the first face of the blanket, about one fourth the length of the blanket from the bottom edge of the blanket;
- at least one complementary set of fasteners attached to the straps, where the fasteners are buttons, snaps, hooks, or a hook and loop type fastener; and
- loops are attached to the first face of the blanket, on the upper half of the blanket, where the loops are adapted to engage the straps.

11. The blanket of claim 1, further comprising at least one pocket disposed on the first, second, or first and second face of the blanket.

12. A convertible blanket, comprising
- a substantially rectangular body, wherein the body
  - has an upper edge, a bottom edge, a left edge, a right edge;
  - has a first face and a second face;
- an opening disposed in the body about one third the length of the blanket from the upper edge of the blanket;
- a first zipper half disposed on the left edge of the blanket body;
- a second zipper half disposed on the right edge of the blanket body, wherein the second zipper half is complementary to the first zipper half;
- a third zipper half disposed on the bottom edge of the blanket body;
- a fourth zipper half disposed on the first face of the blanket body, wherein the fourth zipper half is complementary to the third zipper half, and where the fourth zipper half is disposed about one third the length of the blanket from the bottom edge of the blanket body; and
- a plurality of foot pockets disposed on the bottom edge of the blanket.

13. The blanket of claim 12, wherein the blanket has three foot pockets.

14. The blanket of claim 12, wherein the foot pockets are disposed on the second face of the blanket body.

15. The blanket of claim 12, further comprising a plurality of fasteners disposed on the second face of the blanket body, wherein the fasteners are disposed at about the edges of the upper edge of the blanket and at about one third the blanket's length from the upper edge of the blanket.

16. The blanket of claim 15, wherein the fasteners are buttons, snaps, hooks, or a hook and loop type fastener.

17. The blanket of claim 12, wherein the blanket is made of flannel, polyester, cotton, rayon, silk, satin, terry cloth, Vinyl, or cashmere.

18. The blanket of claim 12, further comprising a plurality of hook disposed on the first face of the blanket, wherein the hooks are D-clips, buckles, spring clips, fabric loops, or stitched loops.

19. The blanket of claim 18, wherein the blanket further comprises a strap, where the strap further comprises nylon webbing, rope, chain, or fabric; and clips attached to the strap and adapted to engage the hooks, thereby allowing a user to carry the blanket.

20. The blanket of claim 12, further comprising a blanket length adjustment system, where length adjustment comprises straps attached to the first face of the blanket, about one fourth the length of the blanket from the bottom edge of the blanket;

at least one complementary set of fasteners attached to the straps, where the fasteners are buttons, snaps, hooks, or a hook and loop type fastener; and loops are attached to the first face of the blanket, on the upper half of the blanket;

where the loops are adapted to engage the straps.

* * * * *